US011140995B2

(12) United States Patent
Choi

(10) Patent No.: US 11,140,995 B2
(45) Date of Patent: Oct. 12, 2021

(54) COLLAPSIBLE BED FRAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 116 days.

(21) Appl. No.: 16/432,017

(22) Filed: Jun. 5, 2019

(65) Prior Publication Data

US 2019/0387889 A1 Dec. 26, 2019

(30) Foreign Application Priority Data

Jun. 21, 2018 (CN) ..... 201810643644.0

(51) Int. Cl.
*A47C 19/12* (2006.01)
*A47C 19/02* (2006.01)

(52) U.S. Cl.
CPC ..... *A47C 19/126* (2013.01); *A47C 19/027* (2013.01)

(58) Field of Classification Search
CPC ... A47C 19/126; A47C 19/027; A47C 19/005; A47C 19/122; A47C 19/025; A47C 19/02; A47C 19/021; A47C 19/14; A47C 19/12; A47C 23/00; A47C 19/124; A47C 19/04; F16B 12/54; F16B 12/56
See application file for complete search history.

(56) References Cited

U.S. PATENT DOCUMENTS 273,332 A 3/1883 Woodin
277,541 A 5/1883 Bowers
372,913 A 11/1887 Hopkins
557,997 A 4/1896 Nessel
687,238 A 11/1901 Johnson
705,384 A 7/1902 Cooper
736,569 A 8/1903 Webb
746,211 A 12/1903 Webb
797,011 A 8/1905 Mosier
984,823 A 2/1911 Linden
1,072,550 A 9/1913 Unknown
1,694,420 A * 12/1928 Joselowitz ..... A47C 19/122 5/112
1,806,358 A 5/1931 Manly
1,833,692 A 11/1931 Silvio
2,057,334 A 10/1936 Hannum
2,492,070 A 12/1949 Stone et al.
2,602,012 A 7/1952 Doty
(Continued)

FOREIGN PATENT DOCUMENTS

DE 102018130110 A1 * 5/2020 ..... A47C 23/005
EP 2182151 A2 5/2010

*Primary Examiner* — Robert G Santos
*Assistant Examiner* — Alison N Labarge
(74) *Attorney, Agent, or Firm* — Morgan, Lewis & Bockius LLP

(57) ABSTRACT

Disclosed are collapsible beds and bed frames. A collapsible bed frame includes first and frame units disposed side by side and connected with each other at their proximal sides. Each of the first and second frame units comprises a plurality of bar units. Adjacent bar units are connected with each other and rotatable with respect to each other along one or more axes each substantially perpendicular to a first plane defined by a top surface of the collapsible bed frame when it is expanded. The first and second frame units can contract and expand while remaining on the first plane and while connected with each other.

20 Claims, 5 Drawing Sheets

(56) References Cited

U.S. PATENT DOCUMENTS 2,680,252 A 6/1954 Hatton
2,772,424 A 12/1956 Roche
2,782,075 A 2/1957 Roscoe
2,823,392 A 2/1958 Howard
2,905,513 A 9/1959 Kane
2,962,085 A 11/1960 Frank
2,983,931 A 5/1961 Nelson
3,245,363 A 4/1966 Kanitz
3,296,983 A 1/1967 Brush
3,504,877 A 4/1970 Lyon, Sr.
3,605,142 A 9/1971 Weinhart
3,613,132 A 10/1971 Weinhart
3,657,748 A 4/1972 Weinhart
3,984,884 A 10/1976 Spitz
4,431,164 A 2/1984 Jungo et al.
4,745,644 A 5/1988 Pottschmidt
4,788,727 A * 12/1988 Liu ..... A47C 19/005 5/174
4,974,526 A 12/1990 Wiygul, Jr.
5,469,589 A 11/1995 Steed
5,562,050 A 10/1996 Colquhoun
5,884,566 A 3/1999 Chen
5,943,968 A 8/1999 Dobson
6,449,786 B1 9/2002 Voit
6,485,219 B1 11/2002 Beyer
7,003,822 B1 2/2006 Sheehy
7,376,986 B2 * 5/2008 Smith ..... A47C 19/124 5/174
7,690,316 B2 4/2010 Yoo
7,739,760 B2 * 6/2010 Wang ..... A47C 27/082 5/176.1
7,784,122 B2 8/2010 Oh
RE41,763 E 9/2010 Ng
7,845,030 B1 * 12/2010 Pollard ..... A47C 19/124 5/308
8,006,328 B2 8/2011 Polevoy
8,006,329 B2 8/2011 Oh
8,042,205 B2 10/2011 Schulz, Jr.
8,176,581 B2 5/2012 Schulz, Jr.
8,678,490 B2 3/2014 Chen
8,822,885 B2 9/2014 Daneshvar
8,832,876 B1 9/2014 Oh
8,935,819 B1 1/2015 Hartley
8,978,176 B1 3/2015 Oh
8,990,979 B1 3/2015 Craver
9,021,964 B2 5/2015 Peng
9,332,833 B2 5/2016 Kim
9,596,943 B1 3/2017 Hartley
9,924,804 B2 3/2018 Hartley
10,321,767 B2 * 6/2019 Jin ..... A47C 19/12
10,687,630 B1 6/2020 Hartley
10,702,070 B2 7/2020 Oh
10,959,529 B2 3/2021 Choi
10,959,530 B2 3/2021 Choi
10,966,537 B1 4/2021 Denney
2006/0107456 A1 * 5/2006 Joseph ..... A47C 17/58 5/2.1
2008/0109958 A1 5/2008 Wang
2009/0025143 A1 * 1/2009 Oh ..... A47C 19/005 5/201
2010/0170190 A1 7/2010 Schulz, Jr.
2010/0171342 A1 7/2010 Chen
2010/0235989 A1 9/2010 Jin
2010/0275372 A1 11/2010 Oh
2010/0299831 A1 12/2010 Lee
2011/0258777 A1 10/2011 Schulz, Jr.
2012/0204770 A1 8/2012 Grace
2012/0304380 A1 12/2012 Jin
2013/0000038 A1 1/2013 Schulz, Jr.
2013/0025051 A1 1/2013 Syrowitz
2014/0208506 A1 * 7/2014 Bartelsmeyer ..... A47C 19/005 5/400
2016/0143446 A1 5/2016 Hartley
2016/0255963 A1 9/2016 Jones
2016/0296004 A1 10/2016 Peng
2018/0042391 A1 2/2018 Oh
2018/0055235 A1 3/2018 Choi
2018/0116412 A1 * 5/2018 Jin ..... A47C 19/122
2018/0140103 A1 5/2018 Thompson
2019/0387888 A1 12/2019 Choi
2019/0387889 A1 12/2019 Choi
2019/0387890 A1 12/2019 Choi
2019/0387891 A1 12/2019 Choi
2019/0387892 A1 12/2019 Choi
2019/0387893 A1 12/2019 Choi
2020/0022501 A1 1/2020 Choi
2020/0022502 A1 1/2020 Choi
2020/0022503 A1 1/2020 Choi
2020/0146438 A1 5/2020 Choi
2020/0378426 A1 12/2020 Choi

* cited by examiner

COLLAPSIBLE BED FRAME

CROSS-REFERENCE TO RELATED APPLICATIONS

The present application claims priority to Chinese Utility Model Application CN 201810643644.0 filed Jun. 21, 2018. The disclosure of the application is incorporated herein for all purposes by reference in its entirety.

FIELD OF THE INVENTION

The present invention generally relates to bed frames and beds, and more particularly, to collapsible bed frames and beds having collapsible bed frames.

BACKGROUND

Existing bed frames are often disassembled and components are packed to save space for shipping convenience and cost reduction. Such a foldable bed frame requires one to assemble all of the disassembled components at his or her own site. It takes time and energy, and in many cases, it is not an easy task. In some cases, the connections among the components are so complicated that assembling a bed frame becomes unmanageable for ordinary end users. This may create an unpleasant experience and disagreeable situation for end users.

Given the current state of the art, there remains a need for collapsible beds and bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides collapsible bed frames and beds having such collapsible bed frames.

In various embodiments, the present invention provides a collapsible bed frame including a first frame unit and a second frame unit disposed side by side, and two first connectors connecting the first and second frame units at their proximal sides. Each first connector includes a first body, a first coupler and a second coupler. The first and second couplers are disposed at the first body and rotatable along a first axis of the first body. The first axis of the first body of each first connector is substantially perpendicular to a first plane defined by a top surface of the collapsible bed frame when it is expanded. The first frame unit is fixedly connected with one of the first and second couplers of each first connector. The second frame unit is fixedly connected with the other one of the first and second coupler of each first connector. Each of the first and second frame units is able to contract and expand while remaining on the first plane. Each of the first and second frame units has a middle pivoting portion such that when in an intermediate state between contracted and expanded states, left sides of the first and second frame units collectively form a substantially "W" shape, and right sides of the first and second frame units form another substantially "W" shape.

In some embodiments, the first body of each first connector has a substantially cylindrical shape.

In some embodiments of each first connector, the first and second couplers are disposed one above the other, and rotate along the first axis of the first body in opposite directions during contraction and expansion of the first and second frame units.

In some embodiments of each first connector, each of the first and second couplers includes a first part rotatably coupled with the first body and a second part extended from the first part, wherein the second part includes a hollow chamber to accommodate an end of the first or second frame unit.

In various embodiments, the collapsible bed frame further includes a middle lateral bar unit. The middle lateral bar unit has a first end fixedly connected with one of the two first connectors and a second end fixedly connected with the other of the two first connectors.

In many embodiments, each of the first and second frame units includes a first longitudinal bar unit, a second longitudinal bar unit, a lateral bar unit and two second connectors. The lateral bar unit is disposed between the first and second longitudinal bar units. Each second connector has a second body and a third coupler. The second body has a second axis substantially perpendicular to the first plane defined by the top surface of the collapsible bed frame when it is expanded, and is fixedly connected with a first end or a second end of the lateral bar unit. The third coupler is disposed at the second body and rotatable along the second axis of the second body, and fixedly connected with an end of the first or second longitudinal bar unit.

In some embodiments, each of the first and second longitudinal bar units includes a first longitudinal segment unit, a second longitudinal segment unit, and a fourth coupler disposed between the first and second longitudinal segment units. Each of the first and second longitudinal segment units is connected with the fourth coupler and rotatable along an axis substantially perpendicular to the first plane defined by the top surface of the collapsible bed frame when it is expanded.

In many embodiments, each of the first and second frame units includes an upper frame, a lower frame disposed below the upper frame, and a plurality of first vertical supporting bars disposed between the upper and lower frames. Each first vertical supporting bar has an upper end connected with the upper frame and a lower end connected with the lower frame. The middle lateral bar unit includes an upper middle lateral bar, a lower middle lateral bar disposed below the upper middle lateral bar, and one or more second vertical supporting bars disposed between the upper and lower middle lateral bars. Each second vertical supporting bar has an upper end connected with the upper middle lateral bar and a lower end connected with the lower middle lateral bar.

In some embodiments, the upper frame includes a plurality of receptacles each configured to removably receive an end of a supporting lateral bar.

In some embodiments, a second vertical supporting bar in the one or more second vertical supporting bars is disposed adjacent each first connector.

In various embodiments, the present invention provides a collapsible bed frame including a first frame unit and a second frame unit disposed side by side and connected with each other at their proximal sides. Each of the first and second frame units includes a plurality of bar units. Adjacent bar units are connected with each other and rotatable with respect to each other along one or more axes, wherein each axis is substantially perpendicular to a first plane defined by a top surface of the collapsible bed frame when it is expanded, thereby allowing the first and second frame units to contract and expand while remaining on the first plane. The plurality of bar units of each of the first and second frame units moves toward the proximal sides of the first and second frame units during contraction, and moves away from the proximal sides of the first and second frame units during expansion.

In some embodiments, the collapsible bed frame further includes two first connectors disposed between the first and second frame units to connect the first and second frame units. Each first connector includes a first body, a first coupler and a second coupler. The first body has a first axis substantially perpendicular to the first plane defined by the top surface of the collapsible bed frame when it is expanded. The first coupler is disposed at the first body and rotatable along the first axis of the first body. The first coupler is fixedly connected to one of the first and second frame units. The second coupler is disposed at the first body and rotatable along the first axis of the first body. The second coupler is fixedly connected to the other one of the first and second frame units.

In some embodiments, the first body of each first connector has a substantially cylindrical shape. In some embodiments, the first and second couplers are disposed one above the other at the first body, and rotate along the first axis of the first body in opposite directions during contraction and expansion of the first and second frame units.

In some embodiments of each first connector, each of the first and second couplers includes a first part rotatably coupled with the first body, and a second part extended from the first part, wherein the second part includes a hollow chamber to accommodate an end of the first or second frame unit.

In various embodiments, a middle lateral bar unit having a first end fixedly connected with one of the two first connectors and a second end fixedly connected with the other of the two first connectors.

In various embodiments, of each of the first and second frame units, the plurality of bar units includes a first longitudinal bar unit, a second longitudinal bar unit, and a lateral bar unit disposed between the first and second longitudinal bar units. Each of the first and second frame units further includes two second connectors, each having a second body and a third coupler. The second body has a second axis substantially perpendicular to the first plane defined by the top surface of the collapsible bed frame when it is expanded, and is fixedly connected with a first end or a second end of the lateral bar unit. The third coupler is disposed at the second body and rotatable along the second axis of the second body, and fixedly connected with an end of the first or second longitudinal bar unit.

In some embodiments, each of the first and second longitudinal bar units includes a first longitudinal segment unit, a second longitudinal segment unit, and a fourth coupler disposed between the first and second longitudinal segment units. Each of the first and second longitudinal segment units is connected with the fourth coupler and rotatable along an axis substantially perpendicular to the first plane defined by the top surface of the collapsible bed frame when it is expanded. When in an intermediate state between contracted and expanded states, the first and second longitudinal segment units of the first and second frame units collectively form a substantially "W" shape.

In many embodiments, each of the first and second frame units includes an upper frame, a lower frame disposed below the upper frame, and a plurality of first vertical supporting bars disposed between the upper and lower frames. Each first vertical supporting bar has an upper end connected with the upper frame and a lower end connected with the lower frame. The middle lateral bar unit includes an upper middle lateral bar, a lower middle lateral bar disposed below the upper middle lateral bar, and one or more second vertical supporting bars disposed between the upper and lower middle lateral bars. Each second vertical supporting bar has an upper end connected with the upper middle lateral bar and a lower end connected with the lower middle lateral bar.

In some embodiments, the upper frame includes a plurality of receptacles each configured to removably receive an end of a supporting lateral bar.

In some embodiments, a second vertical supporting bar in the one or more second vertical supporting bars is disposed adjacent each first connector.

The beds and bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more exemplary embodiments of the present invention and, together with the Detailed Description, serve to explain the principles and implementations of exemplary embodiments of the invention.

Figure 1:
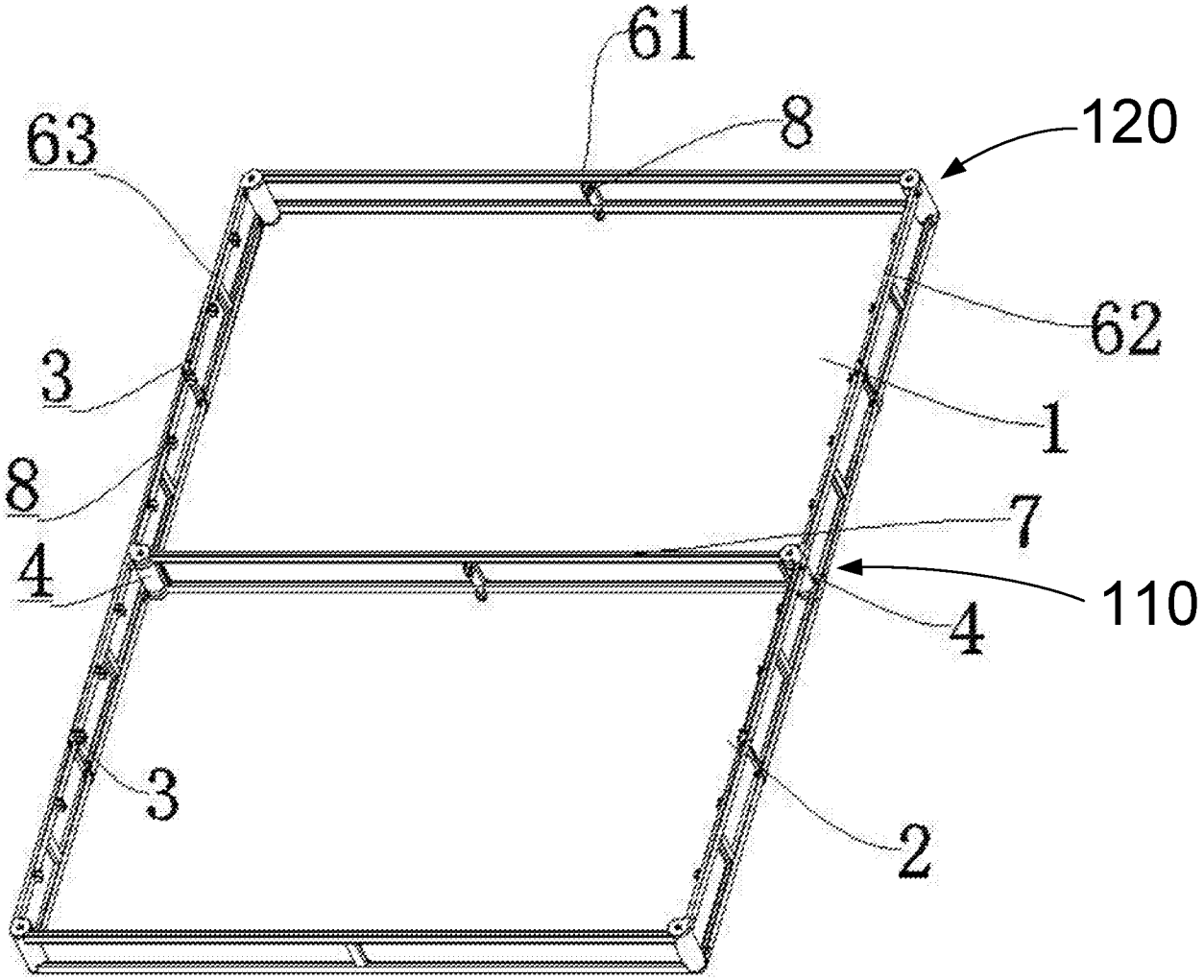
FIG. 1 is a perspective view illustrating an exemplary bed frame in an expanded state in accordance with exemplary embodiments of the present invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only.

Embodiments of the present invention are described in the context of collapsible bed frames and beds having one or more such collapsible bed frames. The collapsible beds and bed frames of the present invention can be of various sizes including, but not limited to, twin, full, queen and king sizes, and of various shapes including but not limited to rectangles and squares. They can be made of various materials including but not limited to metals such as steel or aluminum, plastics and woods.

In general, a collapsible bed frame of the present invention includes one or more frame units, each capable of contracting and expanding while remaining on a plane defined by a top surface of the collapsible bed frame when it is expanded. The plane defined by the top surface of the collapsible bed frame when it is expanded is referred herein as the first plane. In many cases, the first plane is substantially parallel to the top surface of the collapsible bed frame when it is expanded. In some embodiments, the first plane is considered as the space defined by the top surface and the bottom surface of the collapsible bed frame when it is expanded.

A collapsible bed frame of the present invention can include a single frame unit, disclosed herein, that can contract and expand within the first plane. In many cases, a collapsible bed frame of the present invention includes two, three, four, or more frame units, of which adjacent frame units are disposed side by side and connected with each other. Each of these two, three, four, or more frame units can contract and expand while remaining on the first plane and connected with the other frame units. It should be noted that the two, three, four, or more frame units can have substantially the same configuration or different configurations as long as each of them can contract and expand while remaining on the first plane and connected with the other frame units.

In various cases, a frame unit includes a plurality of bar units, where adjacent bar units are connected with each other and rotatable with respect to each other along one or more axes each substantially perpendicular to the first plane. For instance, two adjacent bar units can be connected with each other and rotatable with respect to each other along a single common axis substantially perpendicular to the first plane or along two different axes each substantially perpendicular to the first plane.

Figure 4:
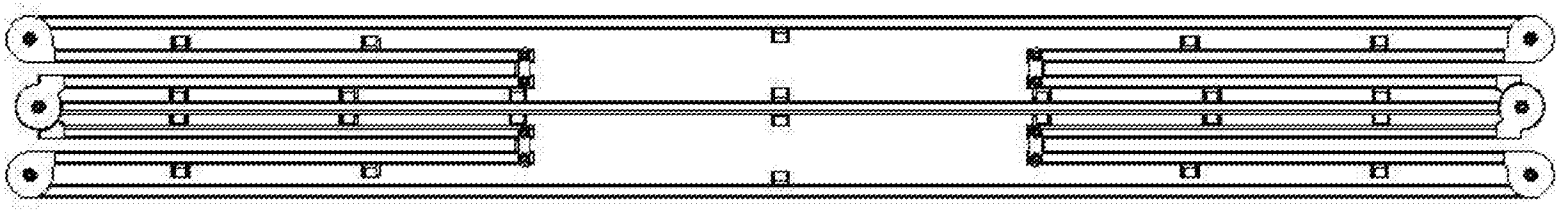
FIG. 4 is a top view illustrating the exemplary bed frame of FIG. 1 in a contracted state.

During contraction, at least a subset of bar units in the plurality of bar units retreats into an interior space defined by the collapsible bed frame when it is expanded. In various cases, the plurality of bar units of each frame unit moves toward the proximal sides of the frame units during contraction, and moves away from the proximal sides of the frame units during expansion. This allows multiple bar units contract onto each other, and thus facilitate multiple bending and contraction of the collapsible bed frame. In many cases, when in an intermediate state between contracted and expanded states, bar units on one side of the collapsible bed frame collectively form a substantial "W" or other zigzag shape, and bar units on the opposite side of the collapsible bed frame, collectively forming another substantial "W" or other zigzag shape. In other words, bar units on each of these two sides are bended multiple times while connected with each other. This significantly reduces the contracted size of the collapsible bed frame as illustrated in FIG. 4 without being disassembled. As such, it can be easily put to use with no need of cumbersome or complicated installation.

It should also be noted that a frame unit can include a single frame, or a stack of frames that includes two, three or more frames arranged one over another. The two, three or more frames can be but not necessarily have to be in direct contact. Similarly, a bar unit can include a single bar or a stack of bars. In additional, a bar can be a whole bar or made of two, three or more segments connected (fixed or movable) with each other.

Figure 2:
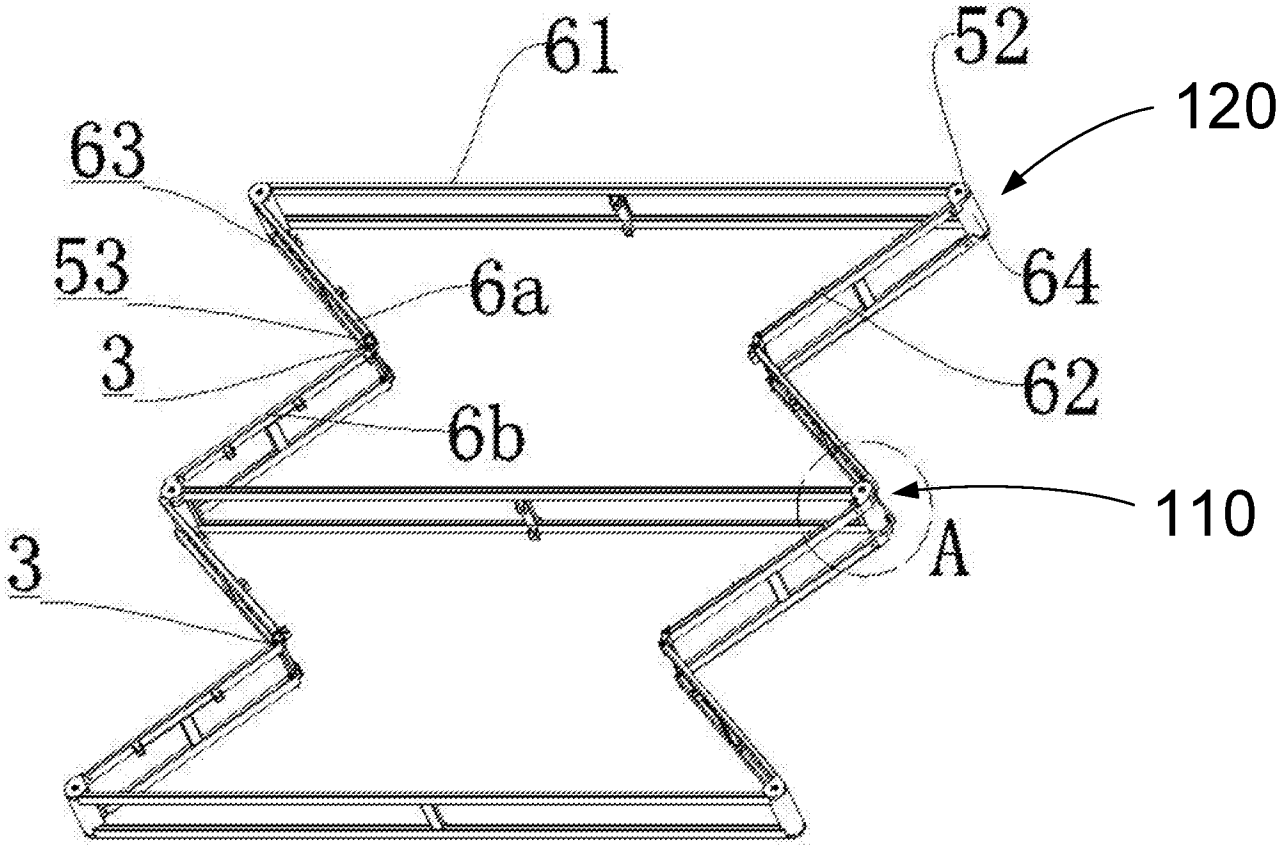
FIG. 2 is a perspective view illustrating the exemplary bed frame of FIG. 1 in an intermediate state.

By way of example, FIGS. 1, 2 and 4 illustrate an exemplary collapsible bed frame including two frame units, e.g., first frame unit 1 and second frame unit 2. In the figures, first frame unit 1 and second frame unit 2 are the same as or similar to each other, resulting in a substantially symmetric collapsible bed frame. It should be noted that first frame unit 1 and second frame unit 2 can be different, for instance, with one frame unit longer than the other in the longitudinal direction of the collapsible bed frame.

FIG. 1 illustrates the collapsible bed frame in an expanded state, where the first and second frame units are disposed side by side and connected with each other at their proximal sides, i.e., the middle of the bed frame in FIG. 1. The sides opposite the proximal sides are referred to as their distal sides, which in some cases correspond to head and foot sides of the bed frame. The other two sides are referred to as left and right sides. It should be noted that the term "middle" as used herein does not necessarily mean the center of the bed frame, and the term "side" does not necessarily mean an outmost edge of the frame unit or an outmost edge of the bed frame.

The top surface of the collapsible bed frame, when it is expanded, defines a plane, referred herein as the first plane. In many cases, the first plane is substantially parallel to the top surface of the bed frame when it is expanded. While remaining on the first plane, each of the first and second frame units can contract from the expanded state as illustrated in FIG. 1 to an intermediate state as illustrated in FIG. 2 and then to a contracted state as illustrated in FIG. 4. The contraction process is reversible. For instance, while remaining on the same first plane, each of the first and second frame units can expand from the contracted state as illustrated in FIG. 4, through the intermediate state as illustrated in FIG. 2, to the expanded state as illustrated in FIG. 1.

In various embodiments, the collapsible bed frame of the present invention is configured such that, during contraction, at least a portion of the collapsible bed frame retreats into an interior space defined by the collapsible bed frame when it is expanded. For instance, in FIG. 2, both the left and right sides of the collapsible bed frame retreat into the interior space, with each of the left and right sides of the collapsible bed frame forming a substantially "W" shape.

Figure 5:
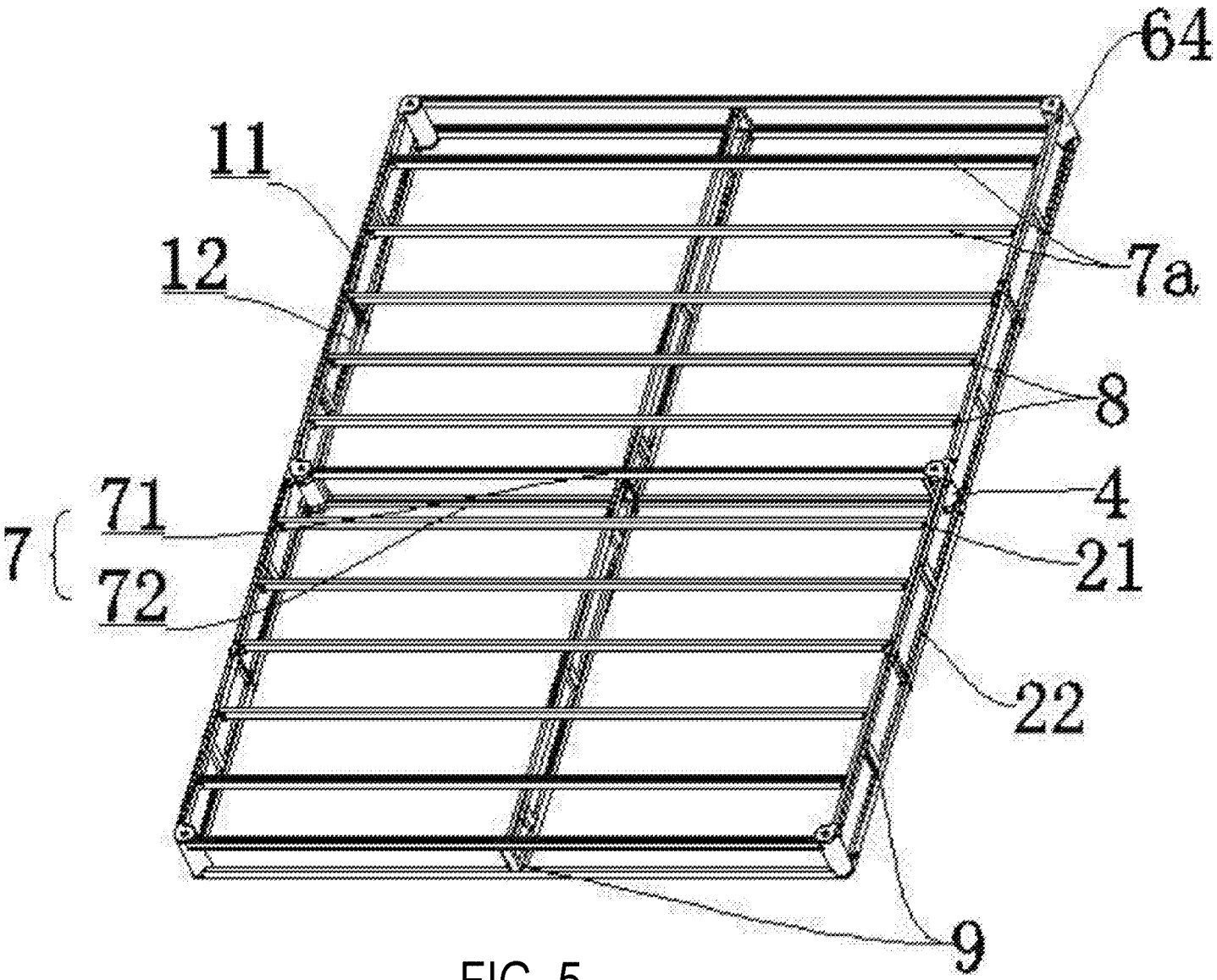
FIG. 5 is a perspective view illustrating an exemplary bed frame in an expanded state in accordance with exemplary embodiments of the present invention.

A frame unit (e.g., first or second frame unit) of the present invention can be a single frame or a stack of frames. By way of example, FIGS. 1, 2 and 5 illustrate each of the first and second frames includes an upper frame such as upper frame 21 and a lower frame such as lower frame 22 stacked one above another. In some embodiments, each of the first and second frames includes a plurality of vertical supporting bars such as vertical supporting bars 9. Vertical supporting bars 9 are disposed between the upper and lower frames. In some embodiments, vertical supporting bar 9 has an upper end connected with the upper frame and a lower end connected with the lower frame. Vertical supporting bars 9 support the upper frame, and distribute the load to the ground through the lower frame.

It should be noted that each of the first and second frames can include one single frame such as upper frame 21 or lower frame 22. Each of the first and second frames can also include upper frame 21, lower frame 22, and at least one additional frame stacked above upper frame 21 or below lower frame 22.

In many embodiments, a collapsible bed frame of the present invention includes one or more connectors disposed between adjacent frame units and configured to connect the adjacent frame units. For instance, by way of example, FIG. 1 illustrates two first connectors 110 disposed between the first and second frame units and configured to connect the first and second frame units.

Figure 3:
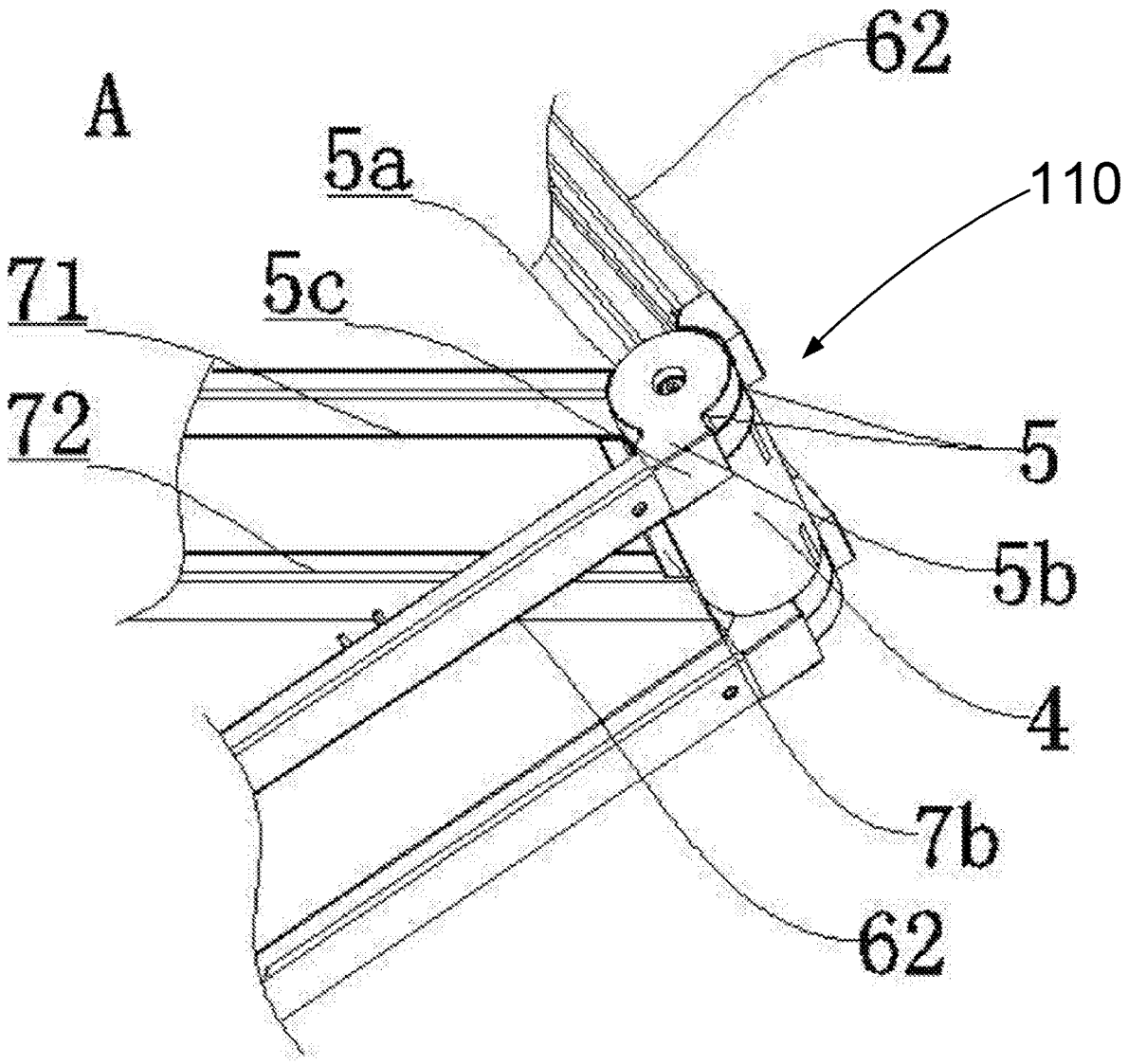
FIG. 3 is an enlarged view of circle A of FIG. 2.

Referring to FIG. 3, first connector 110 includes a body such as first body 4 and a coupling means. First body 4 has a first axis substantially perpendicular to the first plane defined by the top surface of the collapsible bed frame when it is expanded. In an embodiment, first body 4 has a substantially cylindrical shape.

The coupling means of first connector 110 is rotatably disposed at the first body and configured to couple with the first and second frame units. In some embodiments, the coupling means includes a pair of couplers 5 each disposed at the first body and rotatable along the first axis of the first body. One coupler 5 is fixedly connected to the first frame unit, and the other coupler 5 is fixedly connected to the second frame unit. During contraction and expansion of the first and second frame units, the pair of couplers generally rotate along the first axis of the first body in opposite directions. In an exemplary embodiment, the pair of couplers are disposed one above the other at the first body.

In some embodiments, for instance, where each of the first and second frame units include two or more frames stacked together, the coupling means includes multiple pairs of couplers 5. Each pair of couplers 5 connects one respective frame of the first frame unit with one corresponding frame of the second frame unit. By way of example, FIG. 3 illustrates each of the first and second frame units includes an upper frame and a lower frame. The coupling meanings of connector 110 includes two pairs of couplers 5. One pair of couplers 5 is disposed at the upper portion of first body 4 and configured to connect the upper frames of the first and second frame units. The other pair of couplers 5 is disposed at the lower portion of first body 4 and configured to connect the lower frames of the first and second frame units.

In some embodiments, coupler 5 includes first part 5*a* and second part 5*b*. First part 5*a* is configured to couple with first body 4 of first connector 110. Second part 5*b* is extended from the first part and configured to couple with the first or second frame unit. In an embodiment, second part 5*b* includes a hollow chamber such as chamber 5*c* to accommodate an end of the first or second frame unit (e.g., an end of a bar of the first or second frame unit).

In many embodiments, a frame unit includes a plurality of bar units. By way of example, FIG. 2 illustrates each of first frame unit 1 and second frame unit 2 including lateral bar unit 61, first longitudinal bar unit 62 and second longitudinal bar unit 63. It should be noted that first frame unit 1 and second frame unit 2 can include different bar units and can include different numbers of bar units.

Lateral bar unit 61 is disposed between the first and second longitudinal bar units. Lateral bar unit 61 has a first end (e.g., the left end in FIGS. 1 and 2) connected with first longitudinal bar unit 62, and a second end (e.g., the right end in FIGS. 1 and 2) connected with second longitudinal bar unit 63.

In some embodiments, lateral bar unit 61 is connected with the first or second longitudinal bar unit by a connector such as second connector 120. Second connector 120 includes a body such as second body 64 and a coupling meanings. Similar to first body 4 of first connector 110, second body 64 of second connector 120 has an axis, e.g., second axis, substantially perpendicular to the first plane defined by the top surface of the collapsible bed frame when it is expanded. In an embodiment, second body 64 has a substantially cylindrical shape. In some embodiments, the first or second end of the lateral bar unit is fixedly connected with second body 64.

The coupling means of second connector 120 is rotatably disposed at the second body and configured to couple with the first or second longitudinal bar unit. For instance, in some embodiments, the coupling means of second connector 120 include one or more couplers 52 disposed at the second body and rotatable along the second axis of the second body. Coupler 52 is configured to fixedly connect with an end of the first or second longitudinal bar unit. It can be the same as, similar to, or different from coupler 5.

In some embodiments, a bar unit can be a single bar or a stack of bars. By way of example, FIGS. 1 and 2 illustrate each of the lateral bar unit, the first longitudinal bar unit and the second longitudinal bar unit includes an upper bar and a lower bar. In an embodiment, the coupling means of second connector 120 include two couplers 52. One coupler 52 is disposed at the upper portion of second body 64 and configured to connect with the upper bar of the first or second longitudinal bar unit. The other coupler 52 is disposed at the lower portion of second body 64 and configured to connect with the lower bar of the first or second longitudinal bar unit. Collectively, the connected upper bars of these bar units form the upper frame of the frame unit, and the connected lower bars of these bar units form the lower frame of the frame unit.

In many embodiments, a longitudinal bar unit includes two or more longitudinal segment units, where adjacent longitudinal segment units are connected with each other and rotatable along one or more axes each substantially perpendicular to the first plane. By way of example, FIGS. 1 and 2 illustrate each of first longitudinal bar unit 62 and second longitudinal bar unit 63 includes two longitudinal segment units such as first longitudinal segment unit 6*a* and second longitudinal segment unit 6*b*. It should be noted that first longitudinal bar unit 62 and second longitudinal bar unit 63 can include different segment units and can include different numbers of segment units.

The first and second longitudinal segment units are connected with each other at their proximal ends, for instance, by third connector 3. Third connector 3 is configured to allow the first and second longitudinal segment units to rotate along one or more axes each substantially perpendicular to the first plane defined by the top surface of the collapsible bed frame when it is expanded. In some embodiments, third connector 3, or third connector 3 along with proximal ends of first and second longitudinal segment units, is referred to as a middle pivoting portion of the first or second frame unit. During contraction, this middle pivoting portion of the first or second frame unit retreats into an interior space defined by the collapsible bed frame when it is expanded. Consequently, lateral bar unit 61, first longitudinal bar unit 62 and second longitudinal bar unit 63 of each of first frame unit 1 and second frame unit 2 all move toward the proximal sides of the first and second frame units during contraction. Conversely, during expansion, lateral bar unit 61, first longitudinal bar unit 62 and second longitudinal bar unit 63 of each of first frame unit 1 and second frame unit 2 all move away from the proximal sides of the first and second frame units. In addition, when in an intermediate state, the first and second longitudinal segment units of the first and second frame units collectively form a substantially "W" shape as illustrated in FIG. 2.

Third connector 3 can be configured the same as or similarly to the other connectors disclosed herein. For instance, in some embodiments, third connector 3 is configured the same as or similar to first connector 110, e.g., including a body and one or more pairs of couplers. The body of the third connector has an axis substantially perpendicular to the first plane defined by the top surface of the collapsible bed frame when it is expanded. A pair of couplers of the third connector are disposed at the body and rotatable along the axis of the body of the third connector. Of a pair of couplers, one is configured to fixedly connect with the first longitudinal segment unit and the other is configured to fixedly connect with the second longitudinal segment unit.

Third connector 3 can also be configured differently from connector 110. For instance, in some embodiments, third connector 3 includes one or more fourth couplers 53 to couple with the first and second longitudinal segment units. Fourth coupler 53 can be of any suitable shape including but not limited to a bar, a plate, or the like. In an embodiment, fourth coupler 53 has a first hole and a second hole. The first longitudinal segment unit has a corresponding first hole and the second longitudinal segment unit has a corresponding second hole. The first longitudinal segment unit is coupled with the fourth coupler by a first fastener (e.g., bolt, pin or the like) through the first hole of the fourth coupler and the corresponding first hole of the first longitudinal bar. The first longitudinal segment unit is rotatable along an axis of the first fastener that is substantially perpendicular to the first plane. Similarly, the second longitudinal segment unit is coupled with the fourth coupler by a second fastener (e.g., bolt, pin or the like) through the second hole of the fourth coupler and the corresponding second hole of the second longitudinal bar. The second longitudinal segment unit is rotatable along an axis of the second fastener that is substantially perpendicular to the first plane.

In some embodiments, each of the first and second longitudinal segment units includes an upper bar segment and a lower bar segment. The upper bar segments of the first and second longitudinal segment units are connected by one or more fourth couplers 53, and the lower bar segments of the first and second longitudinal segment units are connected by one or more fourth couplers 53. For instance, in an embodiment, the upper bar segments of the first and second longitudinal segment units are connected by one coupler 53. In another embodiment, the upper bar segments of the first and second longitudinal segment units is connected by two couplers 53, with one placed above and one below the upper bar segments of the first and second longitudinal segment units. The connection with two couplers is relatively stronger than the connection with a single coupler.

In some embodiments, a collapsible bed frame of the present invention includes a middle lateral bar unit fixedly connected with one of the two first connectors and a second end fixedly connected with the other of the two first connectors. As an example, FIGS. 1-3 illustrate middle lateral bar unit 7 disposed between the two first connectors and connected with one first connector at each end. In some embodiments, middle lateral bar unit 7 include upper middle lateral bar 71 and lower middle lateral bar 72 disposed below the upper middle lateral bar. Between the upper and lower middle lateral bars are one or more vertical supporting bars, each having an upper end connected with the upper middle lateral bar and a lower end connected with the lower middle lateral bar. The vertical supporting bar between the upper and lower middle lateral bars can be the same or similar to vertical supporting bar 9. In an embodiment, a vertical supporting bar such as vertical supporting bar **7*b* is disposed between the upper and lower middle lateral bars and adjacent each first connector 110. In some cases, the vicinity around each first connector 110 could experience some excessive load or strain. Vertical supporting bar 7*b* helps to stabilize middle lateral bar unit 7** and prevent potential damage to the middle lateral bar unit, and/or to the first and second frame units. As such, it helps to prolong the life of the bed frame.

In some embodiments, a collapsible bed frame of the present invention includes additional, optional or alternative components. As an example, FIG. 5 illustrates a collapsible bed frame of the present invention includes a plurality of supporting lateral bars **7*a*. To accommodate the supporting lateral bars, upper frame 11 includes a plurality of receptacles, such as receptacles 8, configured to removably receive an end of a supporting lateral bar. A mattress can be placed on the bed frame, where supporting lateral bars 7*a* support the mattress, distribute the load, and make the bed more comfortable. As another example, FIG. 5** illustrates a longitudinal supporting unit across the first and second frame units to support plurality of supporting lateral bars.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first frame unit could be termed a second frame unit, and, similarly, a second frame unit could be termed a first frame, without changing the meaning of the description, so long as all occurrences of the "first frame unit" are renamed consistently and all occurrences of the "second frame unit" are renamed consistently.

What is claimed is:

1. A collapsible bed frame comprising:

a first frame unit and a second frame unit disposed side by side, each comprising:

an upper frame;

a lower frame disposed below and spaced apart from the upper frame; and a plurality of first vertical supporting bars disposed between the upper and lower frames, each first vertical supporting bar having an upper end connected with the upper frame and a lower end connected with the lower frame; and two first connectors connecting the first and second frame units at their proximal sides, wherein each first connector comprises a first body, a lower first coupler and a lower second coupler, an upper first coupler and an upper second coupler, wherein the lower first and second couplers are disposed at a lower portion of the first body and the upper first and second couplers are disposed at an upper portion of the first body, wherein each of the lower first coupler, lower second coupler, upper first coupler and upper second coupler is rotatable along a first axis of the first body, and the first axis of the first body of each first connector is substantially perpendicular to a first plane defined by a top surface of the collapsible bed frame when it is expanded;

wherein:

the upper frames of the first and second frame units are fixedly connected with the upper first and second couplers of the two first connectors;

the lower frames of the first and second frame units are fixedly connected with the lower first and second couplers of the two first connectors;

each of the first and second frame units is able to contract and expand while remaining on the first plane; and each of the first and second frame units has a middle pivoting portion, such that when in an intermediate state between contracted and expanded states, left sides of the first and second frame units collectively form a substantially "W" shape, and right sides of the first and second frame units form another substantially "W" shape.

2. The collapsible bed frame of claim 1, wherein the first body of each first connector has a substantially cylindrical shape.

3. The collapsible bed frame of claim 1, wherein of each first connector, the upper first and second couplers are disposed one above the other, and rotate along the first axis of the first body in opposite directions during contraction and expansion of the first and second frame units; and the lower first and second couplers are disposed one above the other, and rotate along the first axis of the first body in opposite directions during contraction and expansion of the first and second frame units.

4. The collapsible bed frame of claim 1, wherein of each first connector, each of the upper first, upper second, lower first and lower second couplers comprises a first part rotatably coupled with the first body and a second part extended from the first part, wherein the second part comprises a hollow chamber to accommodate an end of the upper or lower frame of the first or second frame unit.

5. The collapsible bed frame of claim 1, further comprising a middle lateral bar unit having a first end fixedly connected with one of the two first connectors and a second end fixedly connected with the other of the two first connectors.

6. The collapsible bed frame of claim 5, wherein the middle lateral bar unit comprises:

an upper middle lateral bar;

a lower middle lateral bar disposed below the upper middle lateral bar; and one or more second vertical supporting bars disposed between the upper and lower middle lateral bars, each second vertical supporting bar having an upper end connected with the upper middle lateral bar and a lower end connected with the lower middle lateral bar.

7. The collapsible bed frame of claim 6, wherein the upper frame comprises a plurality of receptacles each configured to removably receive an end of a supporting lateral bar.

8. The collapsible bed frame of claim 6, wherein a second vertical supporting bar in the one or more second vertical supporting bars is disposed adjacent each first connector.

9. The collapsible bed frame of claim 1, wherein each of the first and second frame units comprises:

a first longitudinal bar unit;

a second longitudinal bar unit;

a lateral bar unit disposed between the first and second longitudinal bar units; and two second connectors, each having a second body and a third coupler;

wherein:

the second body has a second axis substantially perpendicular to the first plane defined by the top surface of the collapsible bed frame when it is expanded;

the second body is fixedly connected with a first end or a second end of the lateral bar unit;

the third coupler is disposed at the second body and rotatable along the second axis of the second body; and the third coupler is fixedly connected with an end of the first or second longitudinal bar unit.

10. The collapsible bed frame of claim 9, wherein each of the first and second longitudinal bar units comprises:

a first longitudinal segment unit;

a second longitudinal segment unit; and a fourth coupler disposed between the first and second longitudinal segment units;

wherein each of the first and second longitudinal segment units is connected with the fourth coupler and rotatable along an axis substantially perpendicular to the first plane defined by the top surface of the collapsible bed frame when it is expanded.

11. A collapsible bed frame comprising:

a first frame unit and a second frame unit disposed side by side and connected with each other at their proximal sides; and two first connectors disposed between the first and second frame units to connect the first and second frame units;

wherein each of the first and second frame units comprises a plurality of bar units, each bar unit in the plurality of bar units comprising an upper bar and a lower bar disposed below and spaced apart from the upper bar, wherein adjacent bar units are connected with each other and rotatable with respect to each other along one or more axes, wherein each axis is substantially perpendicular to a first plane defined by a top surface of the collapsible bed frame when it is expanded, thereby allowing the first and second frame units to contract and expand while remaining on the first plane;

wherein the plurality of bar units of each of the first and second frame units moves toward the proximal sides of the first and second frame units during contraction, and moves away from the proximal sides of the first and second frame units during expansion; and wherein each of the two first connectors comprises:

a first body having a first axis substantially perpendicular to the first plane defined by the top surface of the collapsible bed frame when it is expanded;

an upper first coupler and an upper second coupler disposed at an upper portion of the first body and rotatable along the first axis of the first body, wherein the upper first and second couplers are fixedly connected to upper bars of the first and second frame units and a lower first coupler and a lower second coupler disposed at a lower portion of the first body and rotatable along the first axis of the first body, wherein the lower first and second couplers are fixedly connected to lower bars of the first and second frame units.

12. The collapsible bed frame of claim 11, wherein of each first connector:

the first body has a substantially cylindrical shape;

the upper first and second couplers are disposed one above the other at the first body, and rotate along the first axis of the first body in opposite directions during contraction and expansion of the first and second frame units; and the lower first and second couplers are disposed one above the other at the first body, and rotate along the first axis of the first body in opposite directions during contraction and expansion of the first and second frame units.

13. The collapsible bed frame of claim 11, wherein of each first connector, each of the upper first, upper second, lower first and lower second couplers comprises a first part rotatably coupled with the first body and a second part extended from the first part, wherein the second part comprises a hollow chamber to accommodate an end of the upper or lower bar of the first or second frame unit.

14. The collapsible bed frame of claim 11, further comprising a middle lateral bar unit having a first end fixedly connected with one of the two first connectors and a second end fixedly connected with the other of the two first connectors.

15. The collapsible bed frame of claim 14, wherein the middle lateral bar unit comprises:

an upper middle lateral bar;

a lower middle lateral bar disposed below the upper middle lateral bar; and one or more second vertical supporting bars disposed between the upper and lower middle lateral bars, each having an upper end connected with the upper middle lateral bar and a lower end connected with the lower middle lateral bar.

16. The collapsible bed frame of claim 15, wherein a second vertical supporting bar in the one or more second vertical supporting bars is disposed adjacent each first connector.

17. The collapsible bed frame of claim 11, wherein of each of the first and second frame units, the plurality of bar units comprises a first longitudinal bar unit, a second longitudinal bar unit, and a lateral bar unit disposed between the first and second longitudinal bar units, wherein each of the first and second frame units further comprises:

two second connectors, each having a second body, an upper third coupler, and a lower third coupler, wherein the second body has a second axis substantially perpendicular to the first plane defined by the top surface of the collapsible bed frame when it is expanded;

the second body is fixedly connected with a first end or a second end of the lateral bar unit;

the upper and lower third couplers are disposed at an upper portion and a lower portion of the second body and rotatable along the second axis of the second body;

the upper third coupler is fixedly connected with an end of an upper bar of the first or second longitudinal bar unit; and the lower third coupler is fixedly connected with an end of a lower bar of the first or second longitudinal bar unit.

18. The collapsible bed frame of claim 17, wherein each of the first and second longitudinal bar units comprises:

a first longitudinal segment unit;

a second longitudinal segment unit; and a fourth coupler disposed between the first and second longitudinal segment units;

wherein each of the first and second longitudinal segment units is connected with the fourth coupler and rotatable along an axis substantially perpendicular to the first plane defined by the top surface of the collapsible bed frame when it is expanded; and wherein when in an intermediate state between contracted and expanded states, the first and second longitudinal segment units of the first and second frame units collectively form a substantially "W" shape.

19. The collapsible bed frame of claim 11, wherein each of the first and second frame units comprises:

an upper frame composed of the upper bars of the plurality of bar units;

a lower frame composed of the lower bars of the plurality of bar units and disposed below the upper frame; and a plurality of first vertical supporting bars disposed between the upper and lower frames, each first vertical supporting bar having an upper end connected with the upper frame and a lower end connected with the lower frame.

20. The collapsible bed frame of claim 19, wherein the upper frame comprises a plurality of receptacles each configured to removably receive an end of a supporting lateral bar.

* * * * *